US010753090B2

(12) United States Patent
Gulnick

(10) Patent No.: US 10,753,090 B2
(45) Date of Patent: Aug. 25, 2020

(54) SYSTEM AND METHOD OF CEILING PANEL INSTALLATION

(71) Applicant: James R. Gulnick, Mantua, NJ (US)

(72) Inventor: James R. Gulnick, Mantua, NJ (US)

( * ) Notice: Subject to any disclaimer, the term of this patent is extended or adjusted under 35 U.S.C. 154(b) by 0 days.

(21) Appl. No.: 16/573,694

(22) Filed: Sep. 17, 2019

(65) Prior Publication Data

US 2020/0102743 A1 Apr. 2, 2020

Related U.S. Application Data

(60) Provisional application No. 62/738,293, filed on Sep. 28, 2018.

(51) Int. Cl.

| | |
|---|---|
| ***E04B 9/22*** | (2006.01) |
| ***E04B 9/04*** | (2006.01) |
| *E04B 9/24* | (2006.01) |

(52) U.S. Cl.

CPC ..... *E04B 9/22* (2013.01); *E04B 9/04* (2013.01); *E04B 9/225* (2013.01); *E04B 9/24* (2013.01)

(58) Field of Classification Search

CPC ... E04B 9/22; E04B 9/225; E04B 9/04; E04B 9/24

See application file for complete search history.

(56) References Cited

U.S. PATENT DOCUMENTS 2,098,717 A * 11/1937 Calkins ..... E04B 1/54 52/506.1
4,463,536 A 8/1984 Anderle et al.
4,463,537 A 8/1984 Rodriquez et al.
5,077,951 A 1/1992 Baker
5,836,113 A * 11/1998 Bachman ..... E04D 13/158 52/94
6,317,915 B1 11/2001 Grearson
7,017,317 B2 3/2006 Capozzo
7,614,195 B2 11/2009 Platt et al.
8,051,618 B2 11/2011 Ahren et al.
8,176,700 B2 5/2012 Butcher, Jr. et al.
8,215,075 B2 7/2012 Bergman
8,424,268 B2 4/2013 Field et al.
8,813,441 B2 8/2014 Rizzo
8,997,426 B1 4/2015 McLeod et al.
9,068,358 B2 * 6/2015 MacDonald ..... E04F 13/0805
9,187,896 B1 11/2015 Bergman et al.
9,243,405 B2 1/2016 St-Laurent et al.
9,279,252 B2 3/2016 Waters et al.
9,453,339 B2 9/2016 Baxter et al.
9,650,789 B2 * 5/2017 Gulnick ..... E04F 13/0801
(Continued)

FOREIGN PATENT DOCUMENTS

FR 1499970 A * 11/1967 ..... E04B 9/22

*Primary Examiner* — Adriana Figueroa
(74) *Attorney, Agent, or Firm* — Dunlap, Bennett & Ludwig PLLC

(57) ABSTRACT

Ceiling panel mount system and method includes a plurality of mount brackets. Each of the mount brackets includes a base and a hook. The hook includes a first hook portion extending vertically upward from the base, a second hook portion joined to the first hook portion at a first bend in a first direction and extending horizontally therefrom, and a third hook portion joined to the second hook portion at a second bend in the first direction and extending vertically downward therefrom. A ridge protrudes from an inner surface of the first hook portion.

14 Claims, 4 Drawing Sheets

(56) References Cited

U.S. PATENT DOCUMENTS

| | | | | |
|---|---|---|---|---|
| 9,670,674 | B2 * | 6/2017 | St-Laurent | E04B 9/20 |
| 9,976,311 | B2 * | 5/2018 | Gulnick | E04F 13/0803 |
| 2009/0050775 | A1 * | 2/2009 | Constantinou | A47G 1/1606 248/489 |
| 2011/0099934 | A1 | 5/2011 | Rhoad | |

* cited by examiner

SYSTEM AND METHOD OF CEILING PANEL INSTALLATION

CROSS-REFERENCE TO RELATED APPLICATION

This application claims the benefit of priority of U.S. provisional application No. 62/738,293, filed Sep. 28, 2018, the contents of which are herein incorporated by reference.

BACKGROUND OF THE INVENTION

The present invention relates to ceiling panels and, more particularly, to a system and method of ceiling panel installation.

Overhead installation ceiling panels, such as wood, glass, stone, or other materials, is both difficult and dangerous. Lifting heavy and larger panels over one's head is dangerous and there is a high risk of breaking, chipping, or dropping the panels. Current panel supports lack simple, secure, and safe methods of mounting. During assembly, one runs the risk of panels bumping into one other and damaging expensive finishes. Additionally, of the few traditional methods of ceiling attachment, removal of a single panel requires considerable disassembly of ceiling components.

As can be seen, there is a need for an improved system and method of ceiling panel installation.

SUMMARY OF THE INVENTION

In one aspect of the present invention, a ceiling panel mount system comprises: a plurality of mount brackets each comprising: a base; and a hook comprising a first hook portion extending vertically upward from the base, a second hook portion joined to the first hook portion at a first bend in a first direction and extending horizontally therefrom, and a third hook portion joined to the second hook portion at a second bend in the first direction and extending vertically downward therefrom; and a ridge protruding from an inner surface of the first hook portion, wherein a first mount bracket and a second mount bracket of the plurality of mount brackets releasably couple together by an end of the third hook portion of the first mount bracket resting on the ridge of the second mount bracket and an end of the third hook portion of the second mount bracket resting on the ridge of the first mount bracket.

In another aspect of the present invention, a ceiling panel mount system comprises: a ceiling mount bracket comprising: a base comprising an upper surface and a lower surface, wherein the upper surface is configured to couple to a ceiling; and a hook comprising a first hook portion extending downward from the lower surface of the base, a second hook portion joined to the first hook portion at a first bend in a first direction and extending sideways therefrom, and a third hook portion joined to the second hook portion at a second bend in the first direction and extending upward therefrom; and a ridge protruding from an inner surface of the first hook portion; a panel mount bracket comprising: a base comprising an upper surface and a lower surface, wherein the lower surface is configured to couple to a panel; and a hook comprising a first hook portion extending upward from the upper surface of the base, a second hook portion joined to the first hook portion at a first bend in a first direction and extending sideways therefrom, and a third hook portion joined to the second hook portion at a second bend in the first direction and extending downward therefrom; and a ridge protruding from an inner surface of the first hook portion.

In another aspect of the present invention, a method of mounting a panel to a ceiling comprises steps of: mounting a base of a ceiling mount bracket to a ceiling, wherein the ceiling mount bracket further comprises a hook comprising a first hook portion extending downward from the base, a second hook portion joined to the first hook portion at a first bend in a first direction and extending sideways therefrom, and a third hook portion joined to the second hook portion at a second bend in the first direction and extending upward therefrom, and a ridge protruding from an inner surface of the first hook portion; mounting a base of a panel mount bracket to a panel, wherein the panel mount bracket further comprises a hook comprising a first hook portion extending upward from the base, a second hook portion joined to the first hook portion at a first bend in a first direction and extending sideways therefrom, and a third hook portion joined to the second hook portion at a second bend in the first direction and extending downward therefrom; and hooking the hook of the panel mount bracket to the hook of the ceiling mount bracket by lifting the second hook portion of the panel mount bracket towards the base of the ceiling mount bracket, shifting the panel mount bracket sideways so that the third hook portion of the panel mount bracket is against the first hook portion of the ceiling mount bracket and the third hook portion of the ceiling mount bracket is against the first hook portion of the panel mount bracket, and resting an end of the third hook portion of the panel mount bracket onto the ridge of the ceiling mount bracket and resting an end of the third hook portion of the ceiling mount bracket onto the ridge of the panel mount bracket.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a ceiling mounting system for installation and replacement of decorative panels. The present invention allows panels to be securely installed overhead and removed one at a time with minimal clearance. The system provides a safety drop lock mechanism to prevent fallout in case of accidental bumping. The mechanical design and integration of the pieces allows for panel clearance, preventing panels from bumping into one another while the panels are being put into place. The unique structure and design of the device creates multiple inches of mounting overlap while still only needing a fraction of an inch for separation between panels.

The present invention allows any piece in any place to be quickly installed or removed without bending, twisting, or forcing panels into position. The decorative panel is able to be installed parallel and from below any other panels into a waiting opening with the installation guided by the design of the mounting system to promote secure installation without unnecessary and damaging product collisions.

Figure 1:
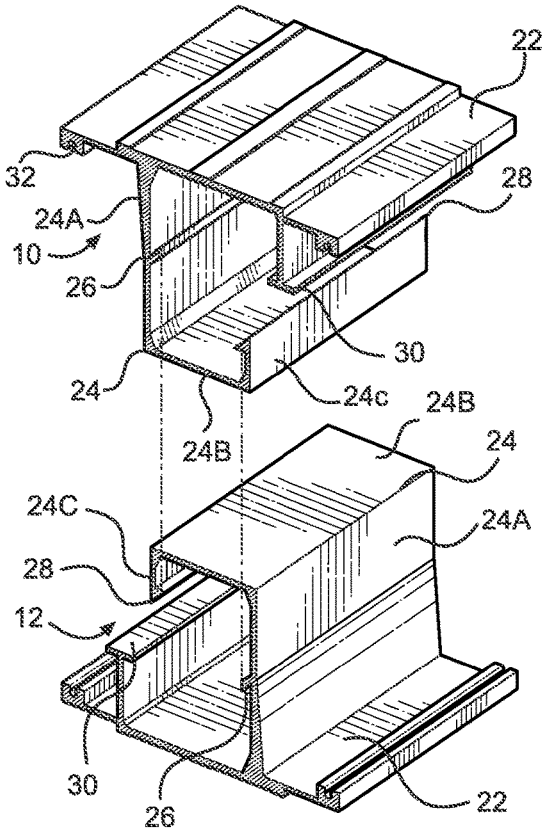
FIG. 1 is an exploded perspective view of an embodiment of the present invention.
Figure 2:
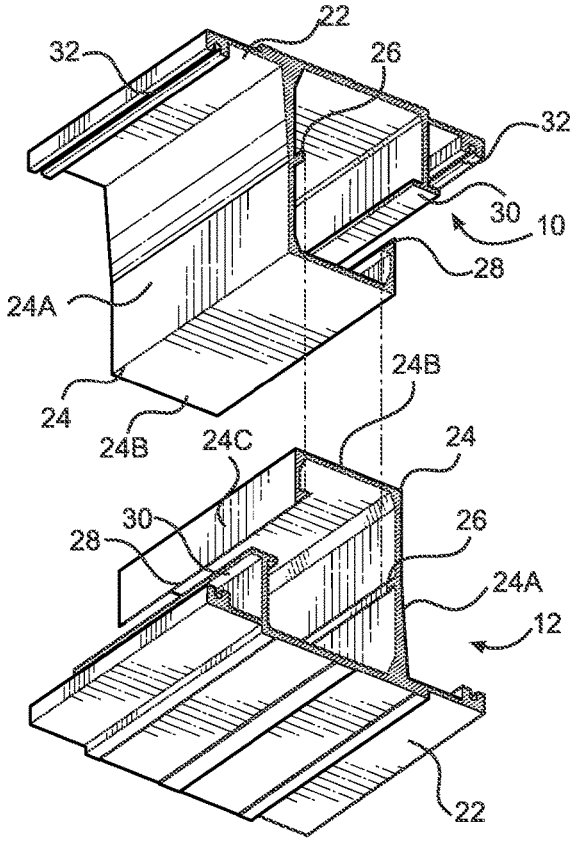
FIG. 2 is an exploded perspective view of an embodiment of the present invention.
Figure 3:
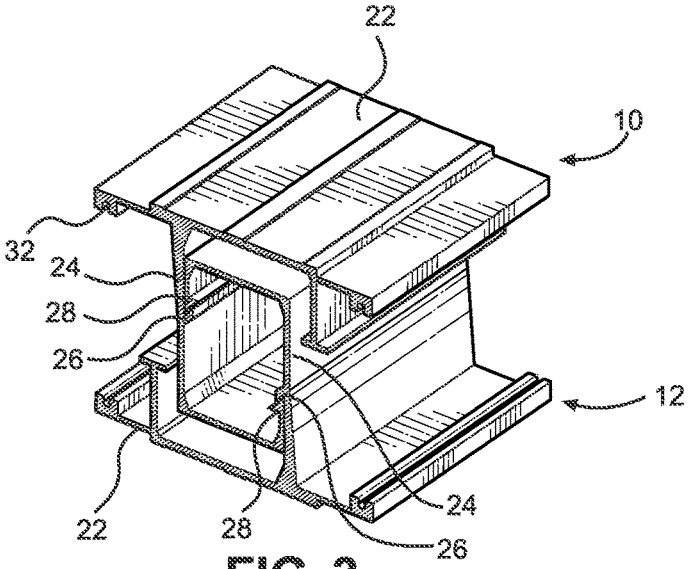
FIG. 3 is a perspective view of an embodiment of the present invention.
Figure 4:
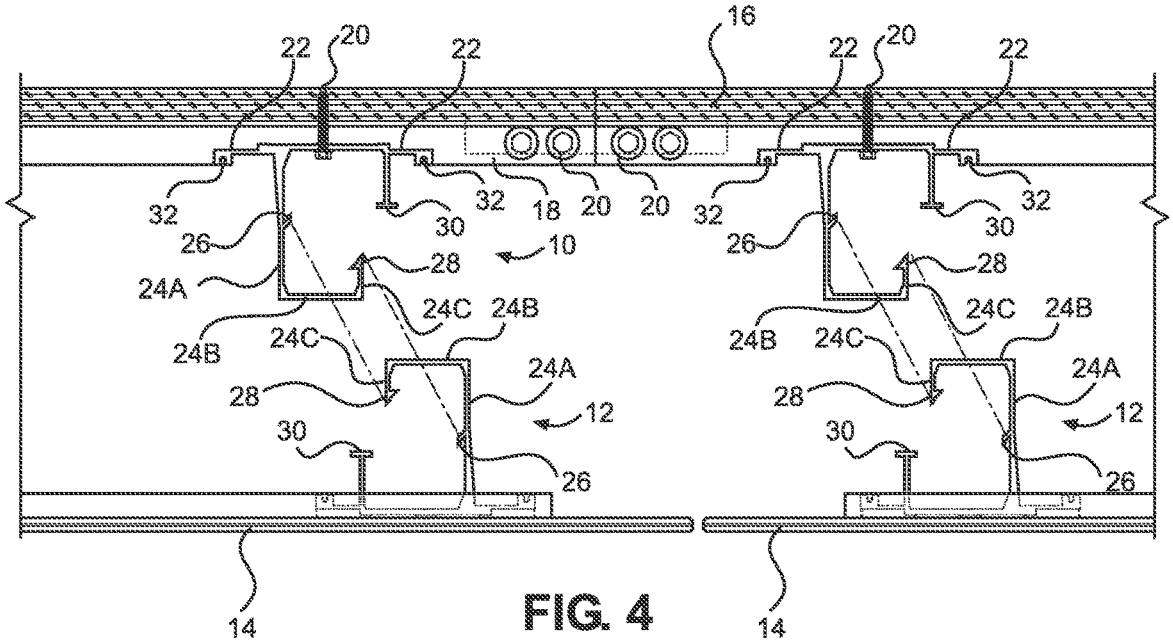
FIG. 4 is a front view of an embodiment of the present invention.
Figure 5:
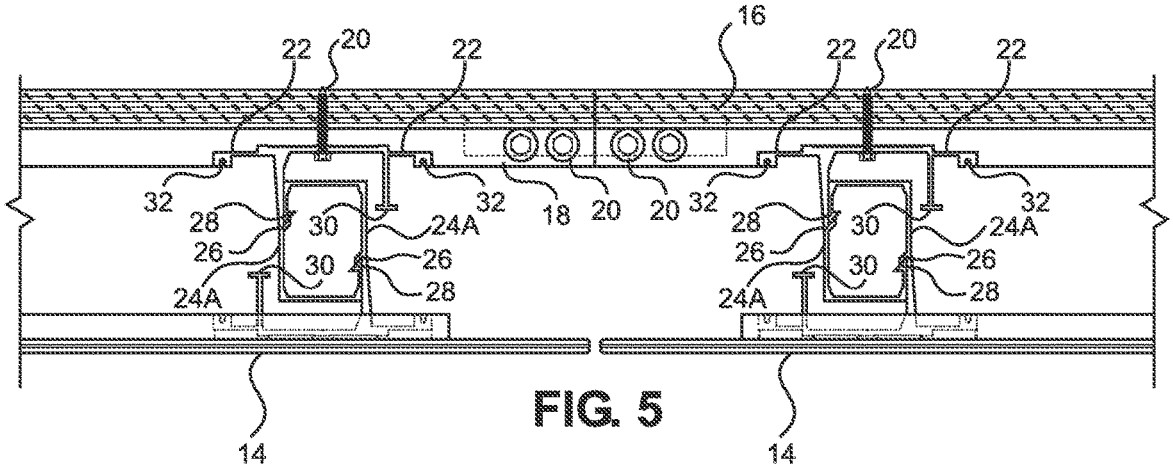
FIG. 5 is a front view of an embodiment of the present invention.
Figure 6:
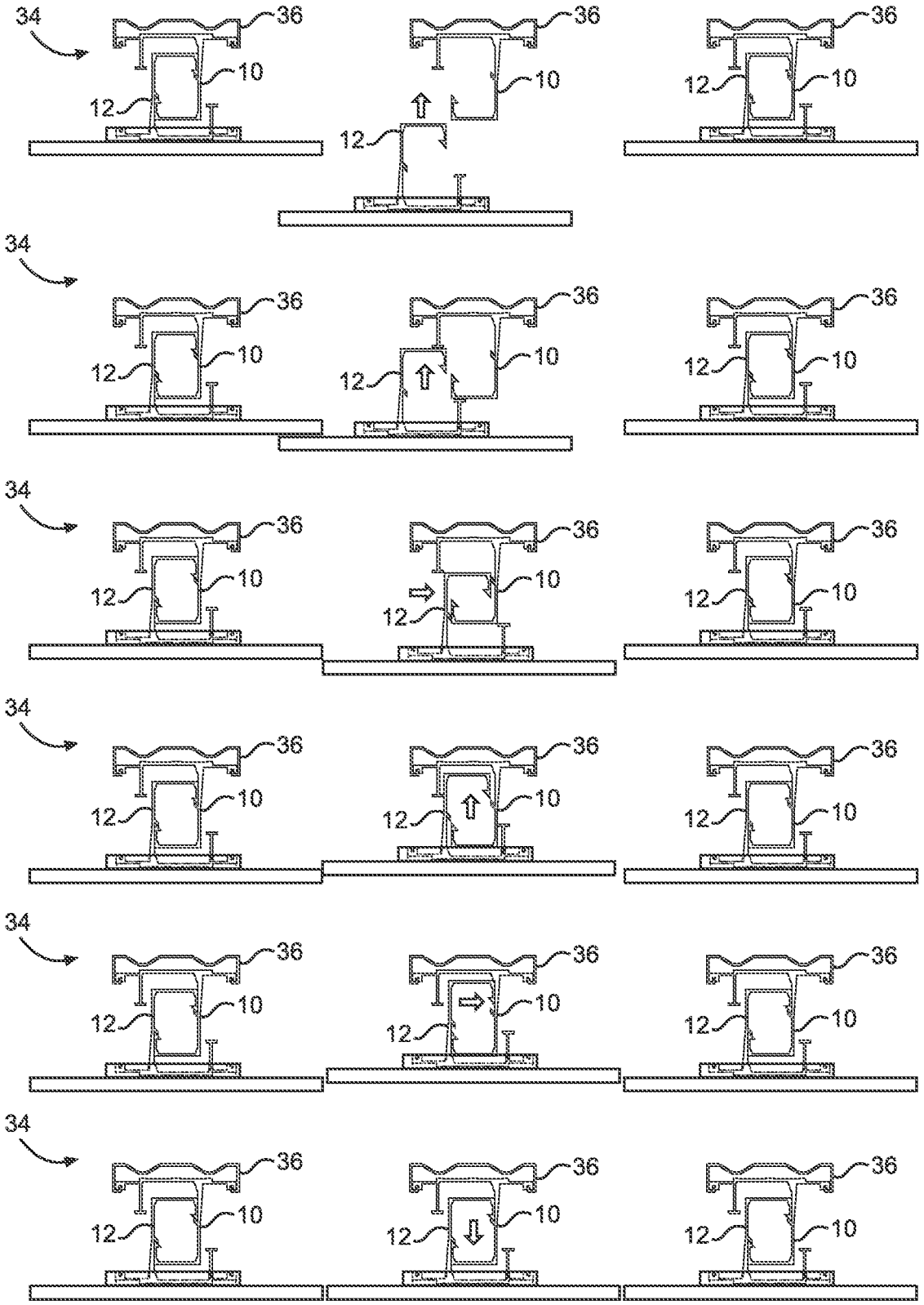
FIG. 6 is a diagrammatic view of a mounting process of an embodiment of the present invention.
Figure 7:
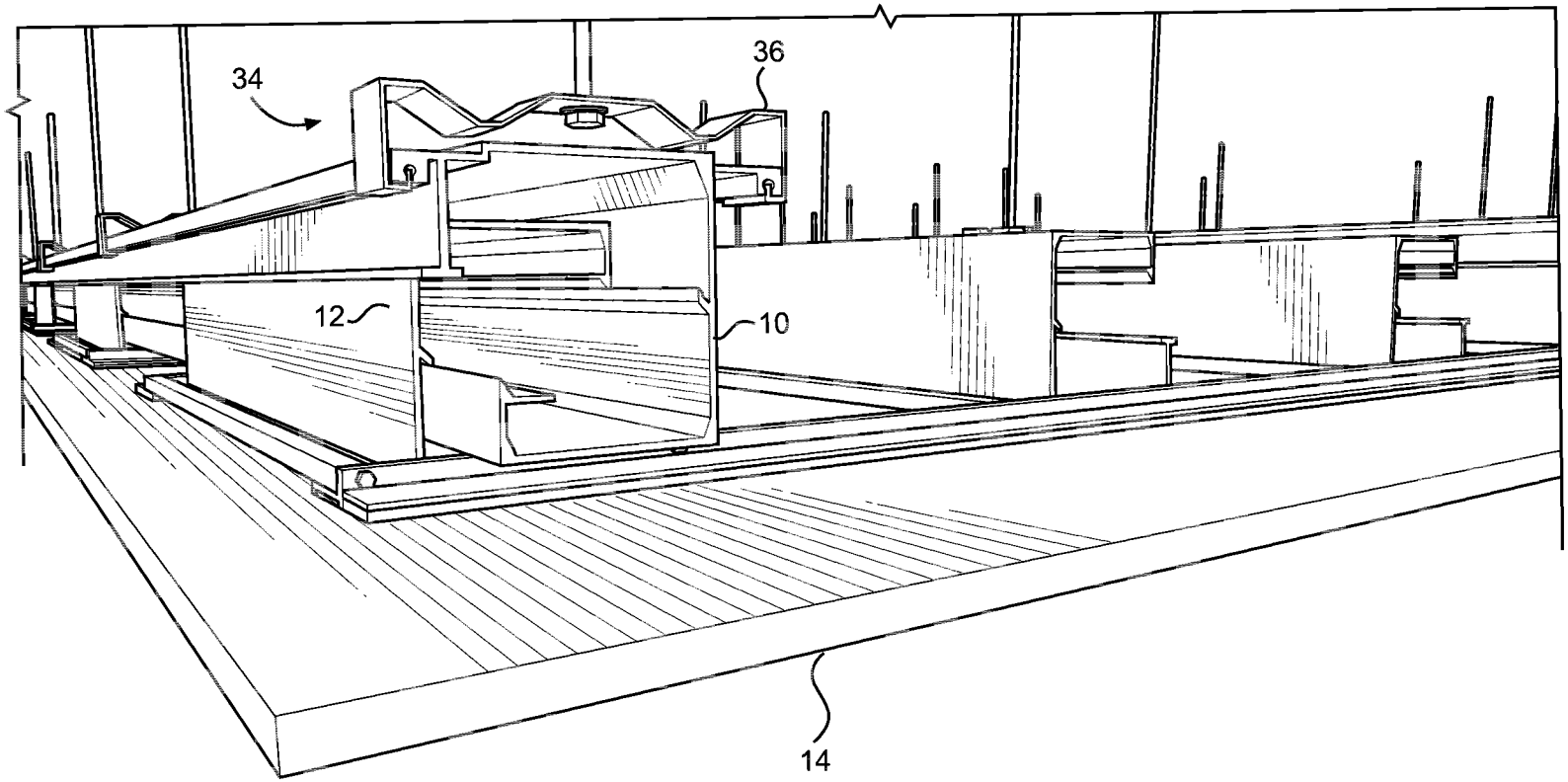
FIG. 7 is a perspective view of an embodiment of the present invention.

Referring to FIGS. 1 through 7, the present invention includes a ceiling panel mount system and method. The ceiling panel mount system and method includes a plurality of mount brackets 10, 12. Each of the mount brackets 10, 12 includes a base 22 and a hook 24. The hook 24 includes a first hook portion 24*a* extending vertically upward from the base 22, a second hook portion 24*b* joined to the first hook portion 24*a* at a first bend in a first direction and extending horizontally therefrom, and a third hook portion 24*c* joined to the second hook portion 24*b* at a second bend in the first direction and extending vertically downward therefrom. A ridge 26 protrudes from an inner surface of the first hook portion 24*a*.

The plurality of mount brackets 10, 12 may include ceiling mount bracket 10 and panel mount brackets 12. Panels 14 are coupled to the lower surface of the base 22 of the panel mount brackets 12. The upper surface of the ceiling mount bracket 10 is coupled to the ceiling 16. The ceiling mount bracket 10 includes a hook 24 facing downwards and the panel mount bracket 12 includes a hook 24 facing upwards. In such embodiments, the first hook portion 24*a* of the ceiling mount bracket 10 extends downward from the lower surface of the base 22 and the first hook portion 24*a* of the panel mount bracket 12 extends upward from the upper surface of the base 22 The ceiling mount bracket 10 releasably couples to the panel mount bracket 12 by an end 28 of the third hook portion 24*c* of the ceiling mount bracket 10 resting on the ridge 26 of the panel mount bracket 10 and an end 28 of the third hook portion 24*c* of the panel mount bracket 12 resting on the ridge 26 of the ceiling mount bracket 10.

To further guide the ceiling mount bracket 10 and the panel mount bracket 12 together, each of the mount brackets 10, 12 may include a stop 30 extending from the base 22. An entrance to the hook 24 is defined between the stop 30 and the third hook portion 24*c*. When pushing the panel 14 upwards toward the ceiling mount bracket 10, the second hook portion 24*b* of the panel mount bracket 12 abuts against the stop 30 of the ceiling mount bracket 10 and the second hook portion 24*b* of the ceiling mount bracket 10 abuts against the stop 30 of the panel mount bracket 12. At this point, the installer shifts the panel mount bracket 12 sideways until the third hook portions 24*c* hit the ridges 26. The panel mount bracket 12 is then pushed upwards again and shifted to the side until the ends 28 are against the inside surface of the first hook portion 24*a* above the ridges 26 and then lowered onto the ridges 26.

In certain embodiments, the end 28 of the third hook portion 24*c* may include a wedge shape. The ridge 26 may have a channel that defines the wedge shape so that the end 28 securely nests within the channel of the ridge 26. In such embodiments, the ridge 26 extends downward an angle relative to the first hook member 24*a* for the panel mount bracket 12 and upward at an angle relative to the first hook member 24*a* for the ceiling mount bracket 10. The wedge shaped end 28 and the wedge shaped channel of the ridge 26 securely fastens the hooks 24 together so that the hooks 24 only disengage from one another when intended.

The present invention may further include a ceiling mount 34 configured to couple the ceiling mount bracket 10 to the ceiling 16. The ceiling mount bracket 10 may include channels 32 defined on opposing sides of the lower surface of the base 22. The ceiling mount 34 may include a hanger clip 36 having U-shaped ends wrapped around the opposing sides of the base 22 and clipped into the channels 32. The hanger clip 36 may be coupled to the ceiling by threaded rods 20, washers, and nuts.

A method of mounting a panel to a ceiling may include the following steps: mount the base of the ceiling mount bracket to a ceiling; mount the base of the panel mount bracket to a panel; and hook the hook of the panel mount bracket to the hook of the ceiling mount bracket by lifting the second hook portion of the panel mount bracket towards the base of the ceiling mount bracket until the second hook portions abut against the stops, shifting the panel mount bracket sideways so that the third hook portions abut against the ridges, lifting the ends up over the ridges, shifting the panel mount bracket sideways again so that the ends or disposed over the ridges, and resting the wedge shaped ends into the wedge shaped channels of the ridges, thereby connecting the mount brackets together and hanging the panel from the ceiling.

It should be understood, of course, that the foregoing relates to exemplary embodiments of the invention and that modifications may be made without departing from the spirit and scope of the invention as set forth in the following claims.

What is claimed is:

1. A ceiling panel mount system comprising:

a plurality of mount brackets each comprising:

a base; and a hook comprising a first hook portion extending vertically upward from the base, a second hook portion joined to the first hook portion at a first bend in a first direction and extending horizontally therefrom, and a third hook portion joined to the second hook portion at a second bend in the first direction and extending vertically downward therefrom; and a ridge protruding from an inner surface of the first hook portion, wherein a first mount bracket and a second mount bracket of the plurality of mount brackets releasably couple together by an end of the third hook portion of the first mount bracket resting on the ridge of the second mount bracket and an end of the third hook portion of the second mount bracket resting on the ridge of the first mount bracket.

2. The ceiling panel mount system of claim 1, wherein each of the plurality of mount brackets further comprise a stop extending vertically upward from the base, wherein an entrance to the hook is defined between the stop and the third hook portion.

3. The ceiling panel mount system of claim 1, wherein the end of the third hook portion comprise a wedge shape and the ridge defines the wedge shape, wherein the end is nested within the ridge.

4. The ceiling panel mount system of claim 3, wherein the ridge extends downward at an angle relative to the first hook member.

5. A ceiling panel mount system comprising:

a ceiling mount bracket comprising:

a base comprising an upper surface and a lower surface, wherein the upper surface is configured to couple to a ceiling; and a hook comprising a first hook portion extending downward from the lower surface of the base, a second hook portion joined to the first hook portion at a first bend in a first direction and extending sideways therefrom, and a third hook portion joined to the second hook portion at a second bend in the first direction and extending upward therefrom; and a ridge protruding from an inner surface of the first hook portion;

a panel mount bracket comprising:

a base comprising an upper surface and a lower surface, wherein the lower surface is configured to couple to a panel; and a hook comprising a first hook portion extending upward from the upper surface of the base, a second hook portion joined to the first hook portion at a first bend in a first direction and extending sideways therefrom, and a third hook portion joined to the second hook portion at a second bend in the first direction and extending downward therefrom; and a ridge protruding from an inner surface of the first hook portion;

the ceiling mount bracket and the panel mount bracket are configured to interlock.

6. The ceiling panel mount system of claim 5, wherein the ceiling mount bracket releasably couples to the panel mount bracket by an end of the third hook portion of the ceiling mount bracket resting on the ridge of the panel mount bracket and an end of the third hook portion of the panel mount bracket resting on the ridge of the ceiling mount bracket.

7. The ceiling panel mount system of claim 5, wherein the ceiling mount bracket further comprises channels defined on opposing sides of the lower surface of the base.

8. The ceiling panel mount system of claim 7, further comprising a ceiling mount configured to couple the ceiling mount bracket to the ceiling.

9. The ceiling panel mount system of claim 8, wherein the ceiling mount comprises a hanger clip comprising U-shaped ends wrapped around the opposing sides of the base and clipped into the channels.

10. The ceiling panel mount system of claim 9, wherein the ceiling mount further comprises threaded rods configured to couple to the ceiling.

11. The ceiling panel mount system of claim 5, wherein the ceiling mount bracket and the panel mount bracket each comprise a stop extending from the base, wherein an entrance to the hook is defined between the stop and the third hook portion.

12. A method of mounting a panel to a ceiling comprising steps of:

mounting a base of a ceiling mount bracket to a ceiling, wherein the ceiling mount bracket further comprises a hook comprising a first hook portion extending downward from the base, a second hook portion joined to the first hook portion at a first bend in a first direction and extending sideways therefrom, and a third hook portion joined to the second hook portion at a second bend in the first direction and extending upward therefrom, and a ridge protruding from an inner surface of the first hook portion;

mounting a base of a panel mount bracket to a panel, wherein the panel mount bracket further comprises a hook comprising a first hook portion extending upward from the base, a second hook portion joined to the first hook portion at a first bend in a first direction and extending sideways therefrom, and a third hook portion joined to the second hook portion at a second bend in the first direction and extending downward therefrom;

hooking the hook of the panel mount bracket to the hook of the ceiling mount bracket by lifting the second hook portion of the panel mount bracket towards the base of the ceiling mount bracket, shifting the panel mount bracket sideways so that the third hook portion of the panel mount bracket is against the first hook portion of the ceiling mount bracket and the third hook portion of the ceiling mount bracket is against the first hook portion of the panel mount bracket, and resting an end of the third hook portion of the panel mount bracket onto the ridge of the ceiling mount bracket and resting an end of the third hook portion of the ceiling mount bracket onto the ridge of the panel mount bracket.

13. The method of claim 12, wherein the ceiling mount bracket and the panel mount bracket each comprise a stop extending from the base, wherein an entrance to the hook is defined between the stop and the third hook portion.

14. The method of claim 13, wherein the second hook portion of the panel mount bracket abuts against the stop of the ceiling mount bracket and the second hook portion of the ceiling mount bracket abuts against the stop of the panel mount bracket after lifting the second hook portion of the panel mount bracket towards the base of the ceiling mount bracket and before shifting the panel mount bracket sideways.

* * * * *